US008474103B2

(12) United States Patent
Lee

(10) Patent No.: US 8,474,103 B2
(45) Date of Patent: Jul. 2, 2013

(54) DOOR HINGE

(75) Inventor: June-Young Lee, Gimhae (KR)

(73) Assignee: Poong Won Industry Co., Ltd. (KR)

( * ) Notice: Subject to any disclaimer, the term of this patent is extended or adjusted under 35 U.S.C. 154(b) by 0 days.

(21) Appl. No.: 13/224,406

(22) Filed: Sep. 2, 2011

(65) Prior Publication Data

US 2012/0060323 A1 Mar. 15, 2012

(30) Foreign Application Priority Data

Sep. 13, 2010 (KR) ..... 10-2010-0089518

(51) Int. Cl.

| | |
|---|---|
| ***E05D 1/00*** | (2006.01) |
| ***E55D 3/14*** | (2006.01) |
| ***E05Y 2900/20*** | (2006.01) |
| ***E05Y 2201/416*** | (2006.01) |
| ***F24C 15/023*** | (2006.01) |

(52) U.S. Cl.
USPC ..... 16/370; 16/371; 16/286; 16/287; 126/194

(58) Field of Classification Search
USPC ..... 16/286, 287, 370, 371, 277; 126/192, 126/194, 197
See application file for complete search history.

(56) References Cited

U.S. PATENT DOCUMENTS

| | | | | | |
|---|---|---|---|---|---|
| 3,003,495 | A | * | 10/1961 | Coultrip | 126/194 |
| 3,067,736 | A | * | 12/1962 | Barefoot | 126/194 |
| 3,150,659 | A | * | 9/1964 | Ellis et al. | 126/194 |
| 3,155,088 | A | * | 11/1964 | Barber | 126/191 |
| 3,170,455 | A | * | 2/1965 | Gass | 126/194 |
| 3,313,918 | A | * | 4/1967 | Barber | 219/412 |
| 3,398,735 | A | * | 8/1968 | Barber | 126/191 |
| 3,677,259 | A | * | 7/1972 | Doner | 126/194 |
| 3,712,287 | A | * | 1/1973 | Summers, Jr. | 126/191 |
| 3,749,080 | A | * | 7/1973 | Kleinhenn | 126/191 |
| 3,842,542 | A | * | 10/1974 | White et al. | 49/386 |
| 3,857,002 | A | | 12/1974 | Lay et al. | |
| 3,955,865 | A | * | 5/1976 | Wilson | 126/191 |
| 4,001,973 | A | * | 1/1977 | Rice et al. | 49/386 |
| 4,138,988 | A | * | 2/1979 | Hurley | 126/194 |
| 4,161,870 | A | | 7/1979 | Barnes | |
| 4,163,344 | A | * | 8/1979 | Scherer | 49/386 |
| 4,163,443 | A | * | 8/1979 | Peterson | 126/197 |

(Continued)

FOREIGN PATENT DOCUMENTS

| | | | |
|---|---|---|---|
| DE | 202004001337 | U1 | 5/2004 |
| JP | 2001-14530 | A | 1/2001 |

(Continued)

*Primary Examiner* — Victor Batson
*Assistant Examiner* — Jason W San
(74) *Attorney, Agent, or Firm* — Park & Associates IP Law, P.C.

(57) ABSTRACT

A door hinge includes a fixing member (10) fixed to a door frame (100), an actuation frame (20) fixed to a door (200) to enable the door to be opened and closed, a slider (22) coupled between the actuation frame and the fixing member, a rotatable moving guide plate (30) rotatably moved around the hinge (34) when the door is opened, and configured to forwardly push the slider, a guide roller (18) to resiliently support the rotatable movement of the rotatable moving guide plate, and a connection frame (60) having one end connected to a slot (11) of the fixing member by a pin (62) and the other end connected to the actuation frame by the hinge (24) and forwardly pushed out when the door is opened along with the slider.

2 Claims, 5 Drawing Sheets

U.S. PATENT DOCUMENTS

| | | | | |
|---|---|---|---|---|
| 4,194,321 | A * | 3/1980 | Hess | 49/389 |
| 4,287,873 | A * | 9/1981 | Goins et al. | 126/194 |
| 4,315,495 | A * | 2/1982 | Jellies | 126/194 |
| 4,499,631 | A * | 2/1985 | Lautenschlager | 16/370 |
| 5,937,481 | A * | 8/1999 | Faringosi | 16/332 |
| 6,035,848 | A * | 3/2000 | Ray et al. | 126/194 |
| 6,539,581 | B1 * | 4/2003 | Faringosi | 16/327 |
| 6,986,187 | B2 * | 1/2006 | Cummins et al. | 16/286 |
| 7,275,283 | B2 * | 10/2007 | Kistner et al. | 16/286 |
| 7,350,273 | B1 * | 4/2008 | Skipper | 16/366 |
| 7,591,046 | B2 * | 9/2009 | Zetti | 16/286 |
| 7,735,943 | B2 * | 6/2010 | Hottmann | 312/401 |
| 7,748,767 | B2 * | 7/2010 | Terhaar et al. | 296/100.06 |
| 7,934,290 | B2 * | 5/2011 | Gherardi et al. | 16/288 |
| 8,122,644 | B2 * | 2/2012 | Jarolim | 49/209 |
| 8,141,835 | B2 * | 3/2012 | Kasai | 248/284.1 |
| 8,157,232 | B2 * | 4/2012 | Kasai | 248/284.1 |
| 8,201,304 | B2 * | 6/2012 | Steurer et al. | 16/286 |
| 8,250,711 | B1 * | 8/2012 | Chen et al. | 16/354 |
| 2003/0172920 | A1 * | 9/2003 | Gronbach | 126/197 |
| 2006/0032019 | A1 * | 2/2006 | Kistner et al. | 16/286 |
| 2007/0193572 | A1 * | 8/2007 | Lee | 126/194 |
| 2007/0209654 | A1 * | 9/2007 | Wang | 126/194 |
| 2011/0146654 | A1 * | 6/2011 | Basavalingappa Mudbasal et al. | 126/194 |
| 2011/0146655 | A1 * | 6/2011 | Basavalingappa Mudbasal et al. | 126/194 |

FOREIGN PATENT DOCUMENTS

| | | | |
|---|---|---|---|
| KR | 10-2004-001175 | A | 1/2004 |
| KR | 10-2007-0048333 | A | 5/2007 |
| KR | 10-2010-0055110 | A | 5/2010 |

* cited by examiner

DOOR HINGE

REFERENCE TO RELATED APPLICATIONS

This application claims the priority benefit of Korean Patent Application No. 10-2010-0089518 filed on Sep. 13, 2010, the entire contents of which are incorporated herein by reference.

FIELD OF THE INVENTION

The present invention relates to a door hinge and, more particularly, to a door hinge which enables a door to be stably opened and closed although a gap is not formed between the door and a door frame.

BACKGROUND OF THE INVENTION

As well known, a door hinge is a device that enables a door to perform the opening and closing operation on a door frame. The door hinge may be divided into a construction in which the door is opened and closed according to a left and right opening and closing method on the basis of its one side and a construction in which the door is opened and closed according to an up and down opening and closing method (that is, a method in which the door appears and disappears while being forwardly covered) on the basis of its upper end.

Meanwhile, the door hinge corresponding to the latter is used in the door of a gas oven range or a microwave oven (that is, electric home appliances). The construction of the conventional door hinge is shown in FIG. 1.

As shown in FIG. 1, the conventional door hinge 150 includes a fixing stand 110 installed in a door frame 100 and a working pole 112 installed in a door 200, coupled to the fixing stand 110 and a hinge 126 and configured to rotatably move around the hinge 126 and open and shut the door 200.

Meanwhile, guide means 114 is provided between the fixing stand 110 and the working pole 112 and configured to guide the opening and closing operation of the door 200.

The guide means 114 includes a coupling plate 116 installed in the fixing stand 110, a rotatable moving plate 120 coupled to the coupling plate 116 and a pin 118 and configured to rotatably move around the pin 118, and a guide pin 124 coupled to the front end of the rotatable moving plate 120 and configured to move up and down along a guide hole 122 formed on both sides of the working pole 112.

When the working pole 112 is rotated and moved, the guide pin 124 of the guide means 114 constructed as above downwardly moves along the guide hole 122 in a vertical direction. At the same time, the rotatable moving plate 118 coupled to the guide pin 124 rotates and moves around the pin 118 along the guide pin 124 and thus guides the rotatably movement of the working pole 112. Accordingly, the door 200 can stably perform the opening operation.

Meanwhile, in an electric home appliance on which the above door hinge is mounted, when the door is opened and closed in the door frame by means of the operation of the door hinge between the door and the door frame, a gap must be formed to some extent in order to prevent the door from being latched in the door frame. Accordingly, the conventional door hinge is disadvantageous in that it is poor in a design and insanitary because dust or insects enter the gap.

SUMMARY OF THE INVENTION

Accordingly, the present invention has been made in view of the above problems occurring in the prior art, and it is an object of the present invention to provide a door hinge which enables a door to be smoothly opened and closed although a gap is not formed between the door and a door frame in such a manner that the door is opened in the state in which the actuation frame of the door hinge installed in the door is forwardly drawn at a predetermined distance when the door is opened.

To achieve the above object, the present invention provides a door hinge comprising a fixing member fixed to and installed in a door frame and an actuation frame fixed to and installed in a door, rotatably moved around a hinge, and configured to enable the door to be opened and closed, the door hinge comprising: a slider configured to have one end connected to the actuation frame and the other end connected to a guide pin inserted into a slant guide hole of the fixing member; a rotatable moving guide plate configured to have one end connected to the guide pin and the other end connected to the fixing member by a hinge, rotatably moved around the hinge when the door is opened, and configured to forwardly push the slider; a guide roller configured to resiliently support the rotatable movement of the rotatable moving guide plate by tensile force of a spring with the guide roller coming in contact with a bottom of the rotatable moving guide plate; and a connection frame configured to have one end connected to a slot of the fixing member by a pin and the other end connected to the actuation frame by the hinge and forwardly pushed out when the door is opened along with the slider, wherein the slider and the connection frame are forwardly pushed out when the door is opened and operated to forwardly draw the actuation frame at a predetermined distance.

The door hinge further comprises a cover frame fixed to and installed in the door and detachably covered in the actuation frame. It is preferred that the cover frame includes a height limit pin engaged with an insertion groove formed at a top end of the actuation frame and configured to limit a height that the actuation frame is inserted; a holder rotatably connected to the height limit pin and configured to have a space into which the top end of the actuation frame is inserted; a latch jaw protruded into one side of the holder and separated from the holder with the latch jaw engaged with a latch groove of the actuation frame when the holder performs a rotation operation; and a spring configured to resiliently support the rotation operation of the holder.

BRIEF DESCRIPTION OF THE DRAWINGS

Further objects and advantages of the invention can be more fully understood from the following detailed description taken in conjunction with the accompanying drawings in which.

DESCRIPTION OF REFERENCE NUMERALS OF PRINCIPAL ELEMENTS IN THE DRAWINGS

| | |
|---|---|
| 10: | fixing member |
| 12: | slant guide hole |
| 14: | guide pin |
| 16: | spring |
| 18: | guide roller |
| 20: | actuation frame |
| 22: | slider |
| 24: | hinge |
| 26: | fixing pin |
| 30: | rotatable moving guide plate |
| 80: | holder |
| 90: | cover frame |
| 100: | door frame |
| 200: | door |

DETAILED DESCRIPTION OF THE INVENTION

An exemplary embodiment of the present invention will now be described in detail with reference to the accompanying drawings. In the following description, a representative embodiment of the present invention will be presented in order to achieve the object. Furthermore, other embodiments that may be presented according to the present invention are replaced with the description in the construction of the present invention.

The present invention is intended to implement a door hinge which enables a door to be smoothly opened and closed although a gap is not formed between the door and a door frame when the door is opened in such a manner that an actuation frame mounted on the door is rotatably operated in the state in which the actuation frame has been forwardly drawn at a predetermined distance from a fixing member on which the door frame is mounted.

The exemplary embodiment of the present invention will now be described in detail with reference to the accompanying drawings.

Figure 1:
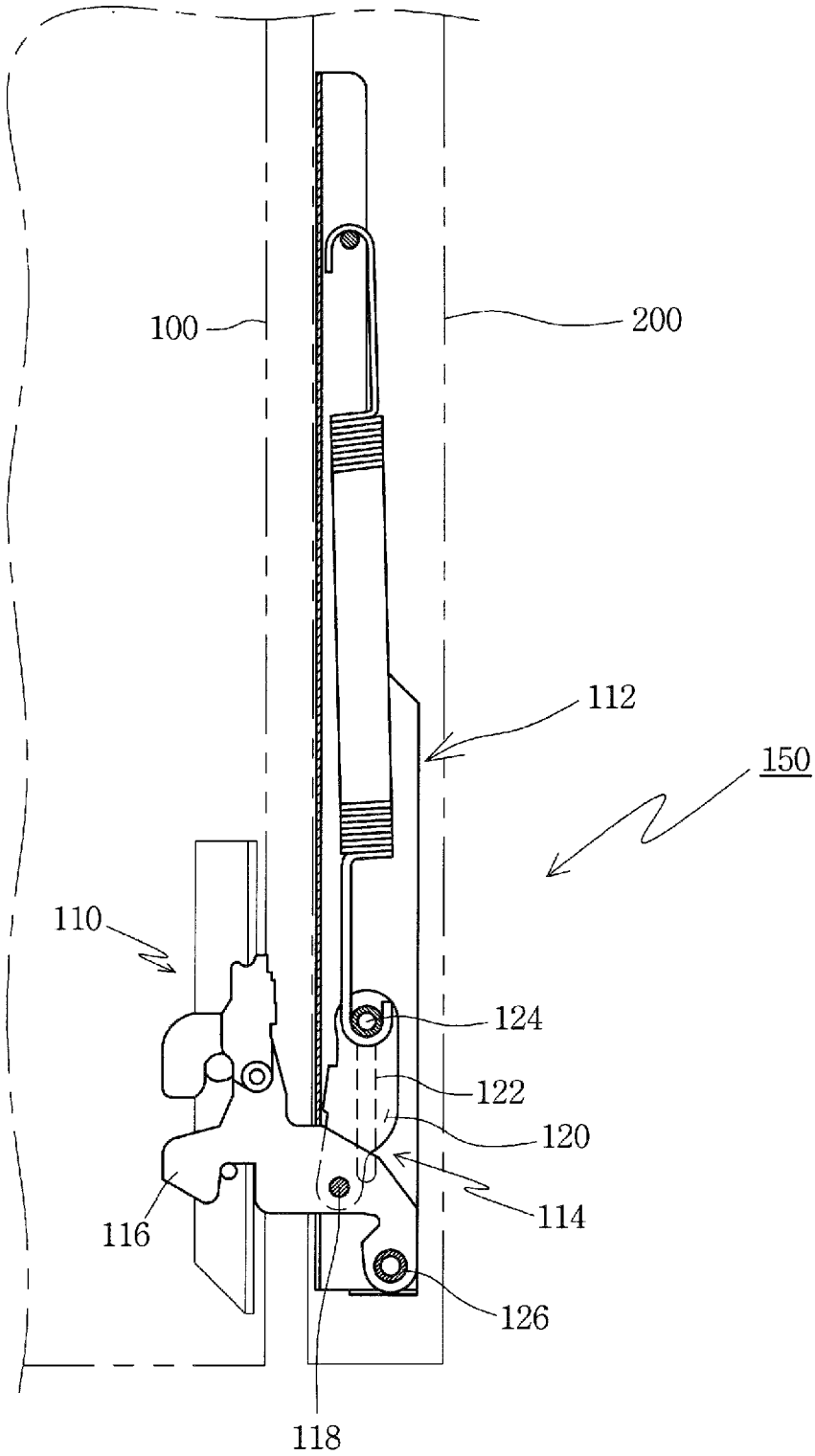
FIG. 1 (PRIOR ART)
FIG. 1 is a diagram showing the construction of a conventional door hinge.
Figure 2:
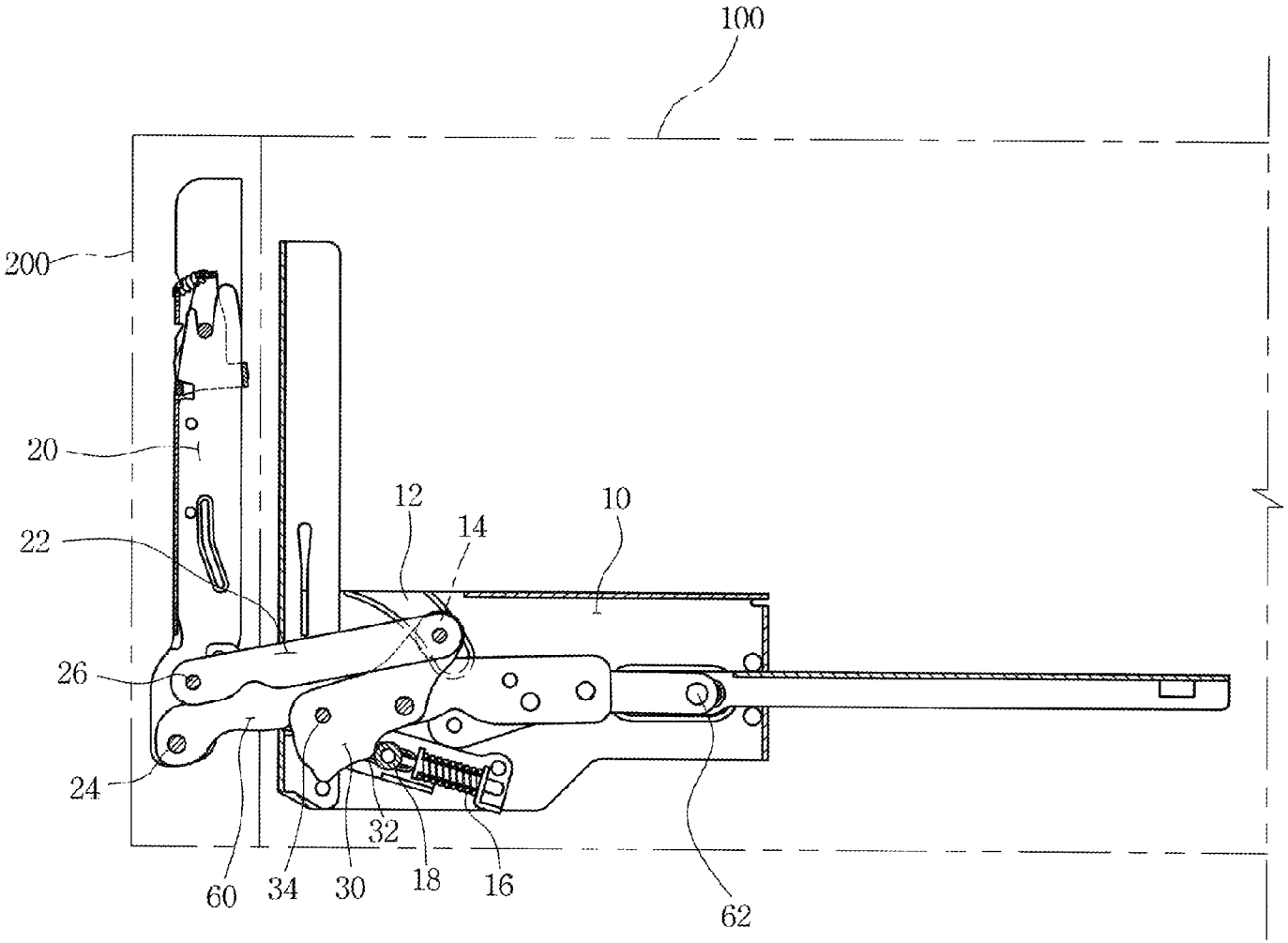
FIG. 2 is a lateral view showing the construction of a door hinge according to an exemplary embodiment of the present invention.
Figure 3:
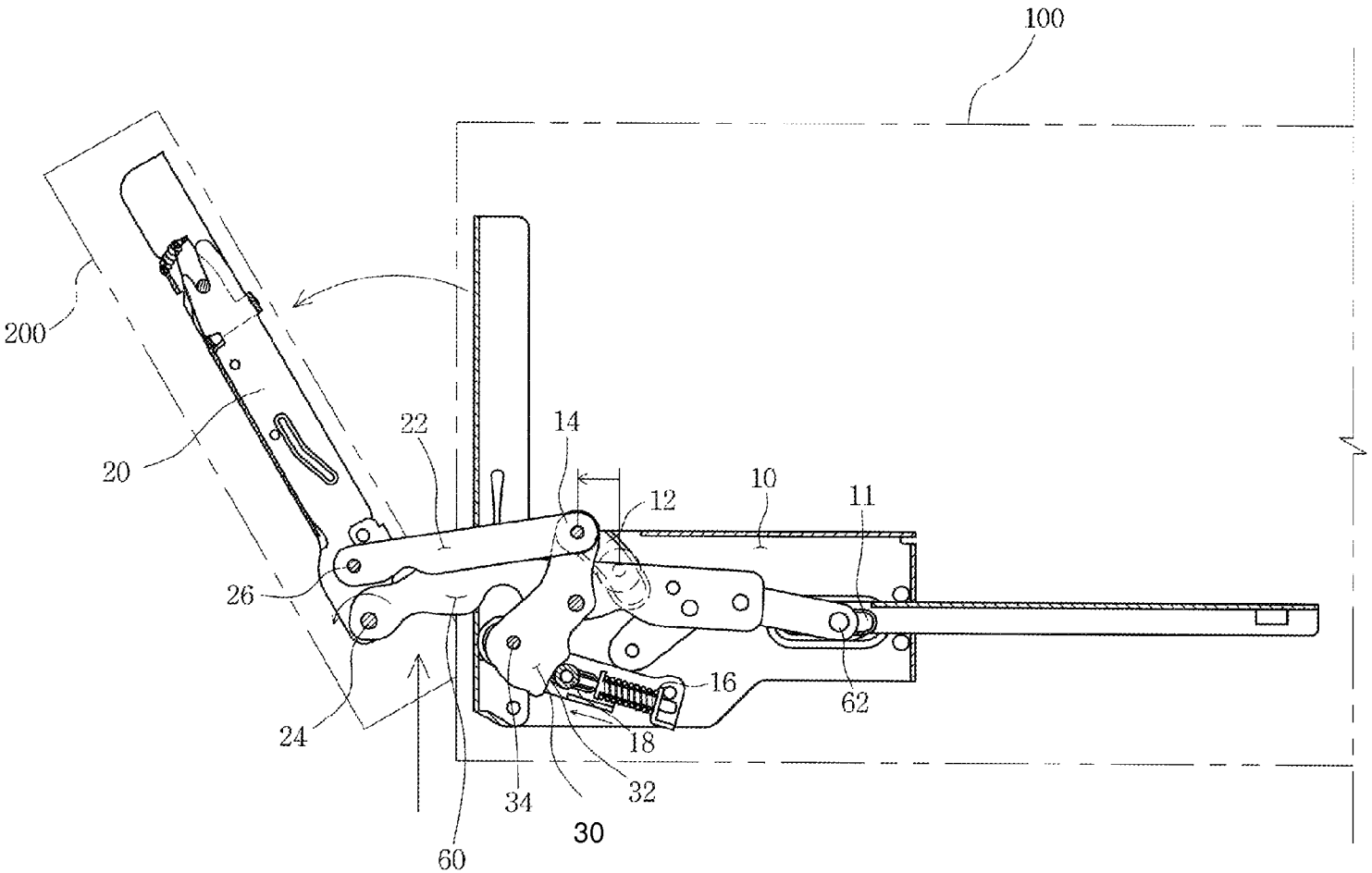
FIG. 3 is a diagram showing the operating state of the door hinge according to the present invention.

FIG. 2 is a lateral view showing the construction of the door hinge according to an exemplary embodiment of the present invention, and FIG. 3 is a diagram showing the operating state of the door hinge according to the present invention.

As shown in FIGS. 2 and 3, the door hinge of the present invention is installed in electric home appliances in which a door 200 is opened and closed according to an up and down opening and closing method (that is, a method in which the door hinge appears and disappears while being forwardly covered) on the basis of its upper end. The door hinge chiefly includes a fixing member 10 mounted on a door frame 100 and an actuation frame 20 mounted on the door 200.

The fixing member 10 is means installed in the door frame 100 and configured to support the elements of the door hinge.

A slant guide hole 12 is formed on the upper side of the fixing member 10 and forwardly slanted at a specific angle in a slot form. A guide pin 14 is inserted into the slant guide hole 12 and connected to one end of a slider 22 connecting the actuation frame 20 and the fixing member 10 together.

The guide pin 14 is connected to a rotatable moving guide plate 30 when the actuation frame 20 is rotatably operated. When the rotatable moving guide plate 30 is rotated around a hinge 34 and upwardly lifted off, the rotatable moving guide plate 30 rides and moves on the slant guide hole 12, thus forwardly pushing the slider 22. Accordingly, the actuation frame 20 is forwardly drawn by the rotation angle of the rotatable moving guide plate 30. The drawing operation of the actuation frame 20 enables the door 200 to be opened in the state in which the door 200 has been forwardly drawn from the door frame 100 at a predetermined distance. Accordingly, although a gap is not formed between the door 200 and the door frame 100, the door 200 can stably perform the opening operation without interference, such as a collision in the door frame 100.

The fixing member 10 is equipped with the rotatable moving guide plate 30. The rotatable moving guide plate 30 has one end connected to the guide pin 14 inserted into the slant guide hole 12 and the other end connected to the fixing member 10 and the hinge 34. Accordingly, when the door 200 is opened, the rotatable moving guide plate 30 is rotatably moved around the hinge 34 and upwardly lifted off. Consequently, the guide pin 14 and the slider 22 connected to the guide pin 14 are forwardly pushed, thereby drawing the actuation frame 20.

A guide curve surface 32 is formed at the bottom of the rotatable moving guide plate 30. A guide roller 18 provided in the fixing member 10 comes in contact with the guide curve surface 32. The guide roller 18 is supported by a spring 16 and resiliently brought into contact with the guide curve surface 32. The guide roller 18 is rotated around the hinge 34 when the door 200 is opened, thus resiliently supporting the rotatable moving guide plate 30 that has been upwardly lifted off.

Meanwhile, a connection frame 60 has one end connected to the fixing member 10 by a pin 62. When the door 200 is opened, the actuation frame 20 mounted on the door 200 is coupled to the other end of the connection frame 60 by means of a hinge 24 and rotatably moved around the hinge 24. Here, when the actuation frame 20 is initially rotated, the actuation frame 20 is forwardly drawn at a predetermined distance by the length that the slider 22 is forwardly pushed out according to the rotation operation of the rotatable moving guide plate 30. Accordingly, although a gap is not formed between the door 200 and the door frame 100, the door 200 can be stably opened without interference, such as a collision in the door frame 100. In detail, when the door 200 is opened, the rotatable moving guide plate 30 is rotatably moved around the hinge 34 and then upwardly lifted off. At this time, the guide pin 14 connected to the rotatable moving guide plate 30 rides on the slant guide hole 12 and moves and, at the same time, the slider 22 connected to the guide pin 14 is forwardly pushed out, thus drawing the actuation frame 20. Accordingly, although a gap does not exist between the door 200 and the door frame 100, the door 200 can be stably opened without interference, such as a collision in the door frame 100, through the drawing operation of the actuation frame 20 when the door is opened.

The connection frame 60 is further installed between the actuation frame 20 and the fixing member 10. The connection frame 60 has one end connected to the fixing member 10 by the pin 62 and the other end connected to the actuation frame 20 by the hinge 24. Accordingly, when the door 200 is being opened, the connection frame 60 is forwardly moved along with the slider 22, so that the actuation frame 20 is forwardly drawn to a predetermined distance. When the connection frame 60 is forwardly moved in response to the opening operation of the door 200, the pin 62 rides on the slot 11 and moves linearly as the pin is inserted in a slot 11 of the fixing member 10. Accordingly, the actuation frame 20 is forwardly drawn to a predetermined distance by the moving length of the pin 62.

Hereinafter, the opening operation of the door hinge according to the present invention is described with reference to FIG. 3.

As shown in FIG. 3, if it is sought to open the door 200, when a door handle (not shown) is forwardly pulled, the actuation frame 20 of the door hinge mounted on the door 200 is rotatably moved around the hinge 24, so that the door 200 is opened. At this time, the rotatable moving guide plate 30 is rotatably moved around the hinge 34 and upwardly lifted off. Accordingly, the guide pin 14 and the slider 22 connected to the guide pin 14 are forwardly pushed to draw the actuation frame 20. Furthermore, the connection frame 60, together with the slider 22, is also forwardly pushed out to draw the actuation frame 20 at a predetermined distance.

That is, although a gap does not exist between the door 200 and the door frame 100 in the state in which the door 200 has been closed, the door 200 is opened in the state in which the door 200 has been forwardly taken off at a predetermined distance through the drawing operation of the actuation frame 20. Accordingly, the door 200 can stably perform the opening operation without interference, such as a collision in the door frame 100.

Figure 4:
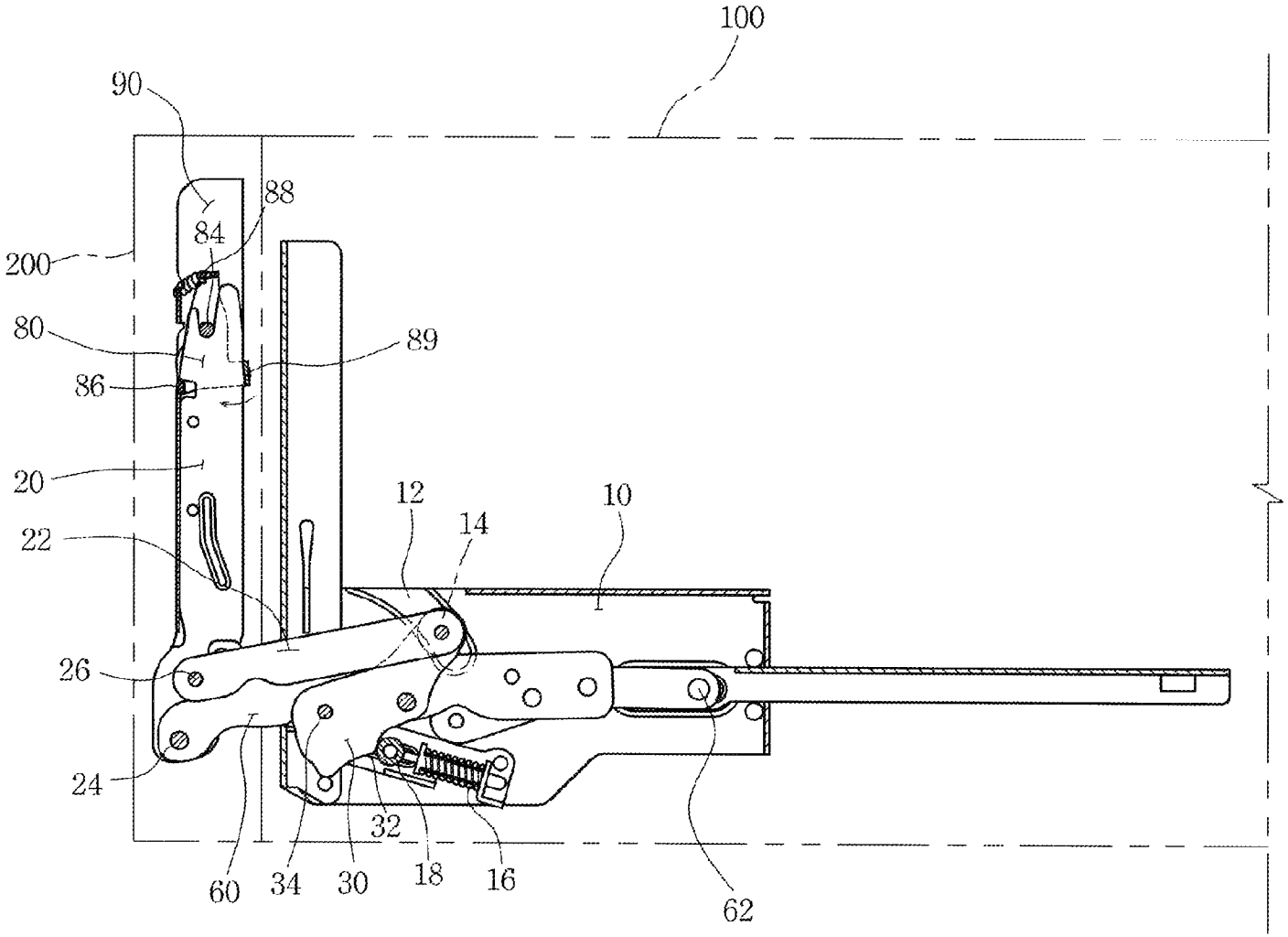
FIG. 4 is a detailed diagram showing a connection relationship between a door and an actuation frame in the door hinge of the present invention.

Meanwhile, FIG. 4 is a detailed diagram showing a connection relationship between the door and the actuation frame in the door hinge of the present invention.

As shown in FIG. 4, a pin insertion groove 70 is further formed at the top end of the actuation frame 20 forming the door hinge, and a latch jaw 72 is further formed on one side of the pin insertion groove 70. Furthermore, a cover frame 90 is installed in the door 200 in which the actuation frame 20 is installed and detachably inserted into the actuation frame 20.

The connection structure of the cover frame 90 and the actuation frame 20 includes a holder 80, a height limit pin 84, a latch jaw 86, a spring 88, and a pressing jaw 89. The holder 80 includes a space into which the top end of the actuation frame 20 is inserted within the cover frame 90. The height limit pin 84 is connected to the holder 80, inserted into the pin insertion groove 70 formed at the top end of the actuation frame 20, and configured to play the role of a central axis on which the holder 80 can be rotated in the state in which the insertion height of the actuation frame 20 has been limited. The latch jaw 86 is protruded into one side of the holder 80 and engaged with the latch groove 72 formed on one side of an upper portion of the actuation frame 20. The spring 88 has one end engaged with the holder 80 and the other end engaged with the cover frame 90. In this state, the spring 88 resiliently supports the holder 80 which is rotatably moved around the height limit pin 84. The pressing jaw 89 is protruded into the other side of the holder 80 and configured to press the holder 80 so that the holder 80 is rotatably operated around the height limit pin 84.

As described above, the actuation frame 20 can be detachably connected to the cover frame 90. Accordingly, a repair or check work can be performed by easily separating the door 200 from the actuation frame 20.

Figure 5:
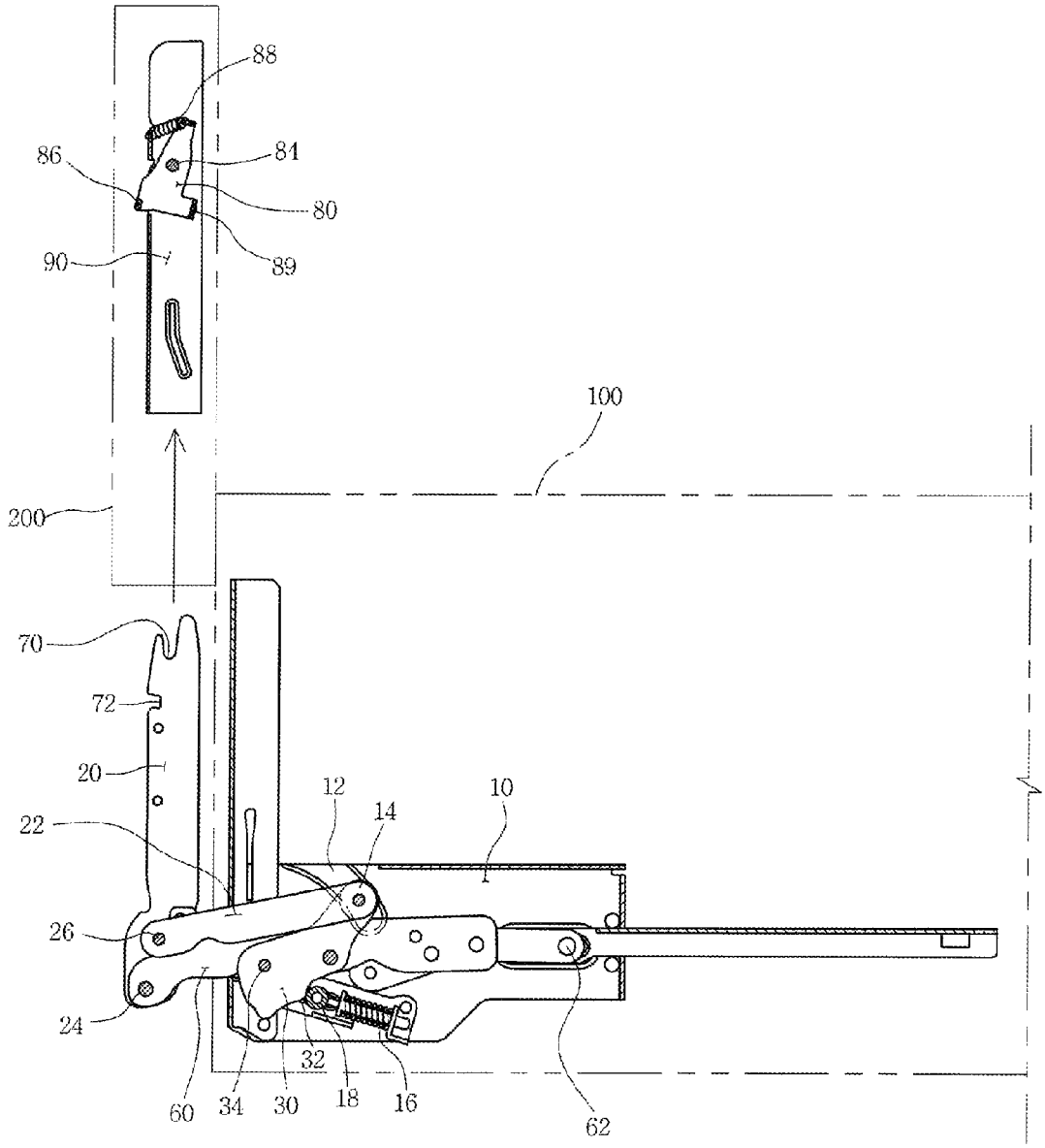
FIG. 5 is a diagram showing the state in which the door has been separated in FIG. 4.

That is, if the door 200 is sought to be separated from the actuation frame 20 in order to perform a check or repair work, the pressing jaw 89 of the holder 80 is pressed as shown in FIG. 5. Accordingly, the holder 80 is rotatably moved around the height limit pin 84 and, at the same time, the latch jaw 86 protruded into one side of the holder 80 is separated from the latch groove 72 of the actuation frame 20. Accordingly, the door 200 can be checked and repaired because the cover frame 90 fixed to the door 200 can be separated from the actuation frame 20.

As described above, in the door hinge according to the present invention, the door is opened in the state in which the actuation frame of the door hinge installed in the door has been forwardly drawn at a predetermined distance. Although a gap is not formed between the door and the door frame, the door can be smoothly opened and closed. Accordingly, the present invention has advantages in that a sanitary problem, such as dust or insects penetrated into a gap between the door and the door frame, and an external appearance problem can be solved.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

What is claimed is:

1. A door hinge for a door comprising:

a fixing member (10) fixed to in a door frame (100), the fixing member (10) having a pin guide slot (11) extending in a lateral direction;

an actuation frame (20) fixed to a door (200), the actuation frame (20) pivotally moveable about a hinge, (24) and configured to move the door (200) between a closed position and an open position;

a slider (22) having one end connected to the actuation frame (20) and the other end connected to a guide pin (14) inserted in a slant guide hole (12) of the fixing member (10);

a rotatable moving guide plate (30) having one end connected to the guide pin (14) and the other end connected to the fixing member (10) by a hinge (34), the rotatable moving guide plate (30) pivotally moveable about the hinge (34) when the door (200) is, operated between the closed and open positions and configured to forwardly push the slider (22) by said pivotal movement about the hinge (34);

a guide roller (18) configured to resiliently support the pivotal movement of the rotatable moving guide plate (30) by of a spring (16), with the guide roller (18) in contact with a bottom surface of the rotatable moving guide plate (30); and a connection frame (60) having one end slidably coupled to the laterally extending pin guide slot (11) of the fixing member (10) by a pin (62) inserted into the pin guide slot (11) and the other end connected to the actuation frame (20) by the hinge (24) and forwardly moveable when the door (200) is operated to the open position from the closed position, wherein, when the door (200) is operated from the closed position to the open position, the slider (22) and the connection frame (60) are simultaneously moveable forwardly, thereby, operating the actuation frame (20) to draw to a predetermined distance and enabling the operation of the door (200) without interference between the door (200) and the door frame (100).

2. The door hinge as claimed in claim 1, further comprising a cover frame (90) fixed to the door (200) and detachably coupled to the actuation frame (20), wherein the cover frame (90) comprises:

a height limit pin (84) coupled to an insertion groove (70) formed at a top end of the actuation frame (20) to limit a height of the actuation frame (20);

a holder (80) rotatably connected to the height limit pin (84) and configured to engage with the top end of the actuation frame (20);

a latch jaw (86) protruded from one side of the holder (80) and configured to detachably engage with a latch groove (72) of the actuation frame (20) when the cover frame (90) is coupled to the actuation frame (20); and a spring (88) configured to resiliently support a rotation operation of the holder (80).

* * * * *